US007201465B2

(12) United States Patent
Sakamoto et al.

(10) Patent No.: US 7,201,465 B2
(45) Date of Patent: Apr. 10, 2007

(54) INK JET PRINTING APPARATUS

(75) Inventors: Atsushi Sakamoto, Kanagawa (JP); Hidehiko Kanda, Kanawaga (JP); Hiroyuki Tanaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 301 days.

(21) Appl. No.: 10/652,658

(22) Filed: Aug. 28, 2003

(65) Prior Publication Data

US 2004/0041879 A1 Mar. 4, 2004

(30) Foreign Application Priority Data

Aug. 29, 2002 (JP) ..... 2002-251922

(51) Int. Cl.
*B41J 2/165* (2006.01)

(52) U.S. Cl. ..... 347/29; 347/23

(58) Field of Classification Search ..... 347/23–35
See application file for complete search history.

(56) References Cited

U.S. PATENT DOCUMENTS 5,075,609 A * 12/1991 Ito et al. ..... 318/696
5,670,997 A * 9/1997 Sugimoto et al. ..... 347/30
2003/0227505 A1 12/2003 Tanaka et al.

FOREIGN PATENT DOCUMENTS

JP 06055730 A * 3/1994
JP 2001-058421 3/2001

* cited by examiner

*Primary Examiner*—Stephen Meier
*Assistant Examiner*—Ly T. Tran
(74) *Attorney, Agent, or Firm*—Morgan & Finnegan, LLP

(57) ABSTRACT

There is provided a small, low-cost, and highly reliable ink jet printing apparatus capable of performing a recovery operation smoothly and forming an image with a stabilized quality. More specifically, when a suction recovery operation for a printing head for ejecting ink is performed, an ejection port surface of the printing head is covered with a cap member, and a cap opening help operation that facilitates the cap opening operation is performed when performing a cap opening operation that separates the cap member from the ejection port surface.

11 Claims, 11 Drawing Sheets

| TOTAL NUMBER OF SUCTION OPERATIONS | CARRIAGE ERROR COUNT | NUMBER OF PRINTED IMAGES SHOWING INFLUENCE OF EJECTION FAILURE DUE TO AIR ENTERED INSIDE EJECTION PORTS |
|---|---|---|
| 50 | 11 | 5 |
| 100 | 25 | 9 |

FIG.6

| TOTAL NUMBER OF SUCTION OPERATIONS | NUMBER OF PRINTED IMAGES SHOWING INFLUENCE OF COLOR MIXTURE |
|---|---|
| 50 | 7 |
| 100 | 12 |

FIG.7

| TOTAL NUMBER OF SUCTION OPERATIONS | CARRIAGE ERROR COUNT | NUMBER OF PRINTED IMAGES SHOWING INFLUENCE OF EJECTION FAILURE DUE TO AIR ENTERED INSIDE EJECTION PORTS | NUMBER OF PRINTED IMAGES SHOWING INFLUENCE OF COLOR MIXTURE |
|---|---|---|---|
| 50 | 0 | 0 | 0 |
| 100 | 0 | 0 | 0 |

FIG.9

| TOTAL NUMBER OF SUCTION OPERATIONS | CARRIAGE ERROR COUNT | NUMBER OF PRINTED IMAGES DEVELOPING INFLUENCE OF EJECTION FAILURE DUE TO AIR TRAPPED INSIDE EJECTION PORTS | NUMBER OF PRINTED IMAGES DEVELOPING INFLUENCE OF COLOR MIXTURE |
|---|---|---|---|
| 50 | 0 | 0 | 0 |
| 100 | 0 | 0 | 0 |

FIG.11

INK JET PRINTING APPARATUS

This application claims priority from Japanese Patent Application No. 2002-251992 filed Aug. 29, 2002, which is incorporated hereinto by reference.

BACKGROUND OF THE INVENTION

1. Field of the Invention

The present invention relates to an ink jet printing apparatus, and more specifically, to a recovery operation performed for a printing head in a printing apparatus of ink jet method for forming an image by ejecting ink to a printing medium.

2. Description of the Related Art

An ink jet printing method is a method that forms an image by ejecting ink (hereinafter referred to also as a printing liquid) of a single color or a plurality of colors provided corresponding to full color printing, onto a printing medium of various kinds, such as paper, a cloth, a nonwoven fabric, OHP transparencies and other types of plastic film, and the like. As an ink jet printing apparatus employing the ink jet printing method, there is available a type of ink jet printing apparatus. This type of ink jet printing apparatus is provided with a carriage mounted with printing means (a printing head) and an ink tank serving as an ink storage portion and moved for scanning in a predetermined main scanning direction with respect to the printing medium, transport means for transporting the printing medium in a direction different from the main scanning direction (that is, a sub-scanning direction), and control means for controlling the carriage and the transport means. As the printing head is made to serially scan in the main scanning direction, ink is ejected from a plurality of ink ejection ports provided in the printing head. Meanwhile, after the serial scan motion, the printing medium is transported a predetermined amount (for example, a printing width of one serial scan motion corresponding to an ejection port arrangement range), thereby accomplishing printing serially on the printing medium. The ink jet printing method as described above employs what is called a drop on-demand method, which ejects ink directly onto the printing medium in accordance with a printing signal, is widely used as an easy and low-cost printing method.

The ink jet printing apparatus is generally comprises an ink jet printing head provided with nozzles disposed at a pitch of 1/300 inches, 1/600 inches, or the like. During a time of a non-printing period, that is, while the ink jet printing head is in a standby state, the printing liquid evaporates from the ejection port at a leading edge of the nozzle and, as a result, viscosity of the printing liquid at and around the ejection port increases. This results in an ejection failure occurring in a printed image in the beginnings of a printing operation initiated next. Specific problems include part of ink dots not formed, a deviation produced in a position a printing liquid droplet lands at, and the like. This results in a blurred or incorrect printed image, or the like, occurring.

Approaches to be described below have been taken to solve these problems. Specifically, a cap made generally of a rubber is contacted with a surface (hereinafter referred to as an "ejection port surface") on which the leading edge of nozzles, that is, the ejection ports are arranged, to prevent the printing liquid from evaporating through the ejection ports. In addition, means for performing ejecting the printing liquid irrelevant to printing at a location other than a printing portion for a predetermined period of time for example at a start of printing (hereinafter referred to as a "preliminary ejection") are provided. With the preliminary ejection, the printing liquid at and around the ejection ports, the viscosity of which has been increased, is discharged out of the ink jet printing head in advance of printing, thus preventing printing image failures from occurring.

In the case that the printing liquid further evaporates and viscosity of the printing liquid further increases, measures are generally taken also, in which the printing liquid is sucked through the cap from the ejection ports or the printing liquid is pressed at an ink supply system to the ink jet printing head, thereby forcing the printing liquid in the nozzles out and then, instead, sending a fresh printing liquid (hereinafter "suction" and "pressurization" are collectively referred to as a "recovery operation").

Further, a supply arrangement is available for supplying the printing head with the printing liquid, in which a printing liquid reservoir reserving therein the printing liquid is installed in the printing apparatus and the printing liquid is supplied from the printing liquid reservoir to the printing head through a supply tube or the like. In this arrangement, when the printing liquid contained in one printing liquid reservoir runs out, that particular printing liquid reservoir is replaced with a new one to permit continued use of the printing liquid. At this time of the replacement of the empty printing liquid reservoir with a new one, the recovery operation described in the foregoing is performed in order to fill a supply path between the printing liquid reservoir and the printing head with the printing liquid. The printing liquid in the supply path evaporates and bubbles are formed and accumulated in the supply path even while the printing liquid in the printing liquid reservoir is being consumed. This also necessitates the recovery operation. The longer the length of the supply path and the smaller the cross-sectional area thereof, the more conspicuous this phenomenon becomes.

With the recent trend in the printing apparatus where the printing apparatus becomes more and more compact, a cartridge type ink jet head having a printing head portion integrated with a printing liquid reservoir portion, and an arrangement allowing the printing liquid reservoir and the printing head to be replaced with a new one independently of each other are spread. Each of these arrangements requires a shorter supply path extending from the printing liquid reservoir to the printing head, reducing an effect from bubbles formed in the supply path on ejection failures. If an arrangement allows only the printing liquid reservoir to be replaced, however, it becomes necessary to perform the recovery operation for filling the supply path with the printing liquid.

FIGS. 1A to 1C are schematic cross-sectional views for explaining the operation of the cap during a suction recovery operation. FIG. 1A shows a capping state of time when, after a cap 103 is brought into tight contact with an ejection port surface 102 of a printing head 101 and a suction pump (not shown) connected to the cap 103 is caused to generate a negative pressure for sucking ink from the ejection ports, the inside of the cap is almost released from the negative pressure (or the capping state of time when the negative pressure has decreased to the extent that does not destroy a meniscus of the ejection port). Shaded portions 104 in FIGS. 1A to 1C represent ink that has been sucked out. In the condition shown in FIG. 1A, an interior of the cap 103 is considered to be substantially filled with ink.

When an attempt is made to pull apart the cap 103 from the ejection port surface in the capping state shown in FIG. 1A, a force sucking up ink, which is caused by an adhesion of the ink and the negative pressure in the ejection ports, acts at an interface between the ejection port surface 102 and the ink 104. In addition, a surface tension, that acts the ink itself to adhere, also acts on the ink inside the cap 103. These forces cause constrictions 105 to be formed in the ink 104. As the cap 103 leaves off the ejection port surface 102, a cross-sectional area of a portion of each of the constrictions 105 in the ink 104 becomes small and the weakest. The cohesion of the ink 104 then eventually is broken at the portion of each constriction 105.

FIG. 1C shows a condition, in which the ink has been broken at each of the shoulders 105. After the ink has been broken, a part of the ink is left on the ejection port surface 102 as shown in FIG. 1C. The amount of ink left on the ejection port surface 102 in this case is more than the amount of ink depositions produced from a mist and the like that is caused during a printing operation, and has tendency to become more when the lower the surface tension of the ink and the lower a water repellency of the ejection port surface 102 become. Also, the more the amount of ink depositions on the ejection port surface 102 is, the greater a load on a wiping blade and a wiper cleaner is, thus shorting a service life thereof. In operating examples shown in FIGS. 1A to 1C, the ink left inside the cap 103 when the cap 103 is released presents another problem of the ink drooping or scattering.

Furthermore, if the cap 103 is separated immediately after the ink has been sucked, an atmospheric pressure is applied instantaneously to the inside of the cap, in which there is left the negative pressure. As a result, sudden fluctuations in pressure and a mechanical impact exerted when the cap is separated destroy the meniscus inside the ejection port, causing air to get into the back of the ejection ports. This results in an ink ejection failure occurring. An arrangement as described in Japanese Patent Application Laid-open No. 2001-58421 is known as a solution to such a problem. According to the arrangement as described in this publication, after the ink has been sucked, the cap is opened after the negative pressure generated in the cap disappears.

There is known another arrangement for solving the problem described in the foregoing, in which an atmospheric air communicating valve is provided as a path allowing an atmosphere air into the cap. According to this arrangement, the atmospheric air communicating valve allows the atmosphere air to be drawn in with the negative pressure generated in the cap kept in a condition of the printing head and the cap being in tight contact with each other. This makes it possible to suppress the amount of ink left on the ejection port surface after the suction of ink and prevent the atmospheric pressure from being instantaneously applied to the inside of the cap.

The ink jet printing apparatus as described in the foregoing nonetheless has the following problems to be solved.

According to the arrangement as described in the aforementioned publication, ink of a mixture of a plurality of different colors stays inside the cap for an extended period of time and can sometimes flow back to the printing head. If an image is printed in this condition, an image problem of a color mixture is likely to occur, in which the original colors are mixed with other ones. If the cap is opened after the negative pressure generated in the cap disappears, after the ink suction, more ink is wastefully discharged through suction, thus presenting another problem of an increasing running cost.

In the arrangement using the atmospheric air communicating valve, there is a problem of difficulty in providing the valve particularly in a small size apparatus. More specifically, the recent trend in ink jet printing apparatuses is toward a smaller size body, which makes it also necessary to make smaller the cap and surrounding mechanisms. As a result, it has become relatively difficult to provide a small cap with the atmospheric air communicating valve or dispose a mechanism for operating the atmospheric air communicating valve. Furthermore, there may be cases, in which a tube for connecting the atmospheric air communicating valve is plugged with dust and dirt and becomes inoperative. Still another problem is that the apparatus gets more complicated in construction or costly, since the atmospheric air communicating valve requires a driving source for the exclusive use thereof or driving from another driving source.

SUMMARY OF THE INVENTION

An object of the present invention is to provide an ink jet printing apparatus capable of performing a recovery operation smoothly and forming an image with a stabilized quality.

There is provided an ink jet printing apparatus comprising:

a carriage mounted with a printing head for ejecting ink and for scanning the printing head in a main scanning direction;

suction means for sucking ink from the printing head;

capping means for performing a cap closing operation in which an ejection port surface of the printing head is covered with a cap member when the suction means sucks ink from the printing head and performing a cap opening operation in which the cap member is separated from the ejection port surface after suction by the suction means; and cap opening help means performing a cap opening help operation that facilitates the cap opening operation, when the capping means performs the cap opening operation.

The above and other objects, effects, features and advantages of the present invention will become more apparent from the following description of embodiments thereof taken in conjunction with the accompanying drawings.

BRIEF DESCRIPTION OF THE DRAWINGS

FIG. 6 is a table showing a frequency of occurrence of a carriage error occurring when a cap is pulled away from a printing head immediately after a suction and a ejection failure occurring as a result of air entered inside an ejection port;

FIG. 7 is a table showing a frequency of occurrence of a color mixture occurring when a cap is separated after a carriage is stopped until a negative pressure in a cap disappears, after a suction operation;

FIG. 9 is a table showing a frequency of occurrence of a carriage error occurring when the suction operation that draws a negative pressure curve as explained in FIG. 8 is performed, an ejection failure occurring as a result of air entered inside an ejection port, and a color mixture;

FIG. 11 is a table showing a frequency of occurrence of a carriage error occurring when the cap is opened after a suction, an ejection failure occurring as a result of air entered inside an ejection port, and a color mixture in the ink jet printer mounted with the sequence as explained in FIG. 10.

DETAILED DESCRIPTION OF PREFERRED EMBODIMENTS

Preferred embodiments according to the present invention will be described in detail with reference to the accompanying drawings.

(First Embodiment)

Figure 1A:
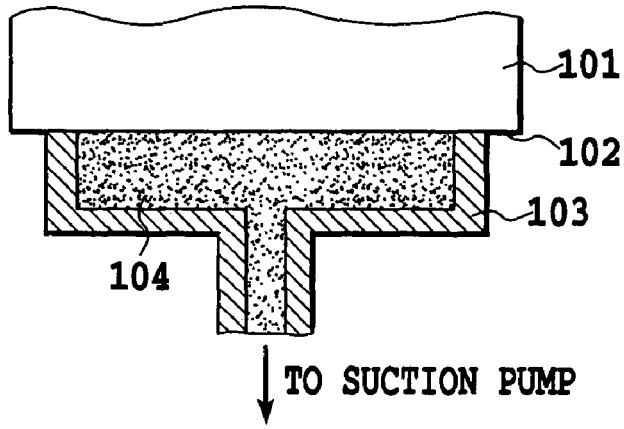
FIGS. 1A to 1C are schematic fragmentary sectional views for explaining a suction recovery operation in a conventional ink jet printing apparatus, in which a cap is separated in a parallel attitude with respect to a movement of a carriage.
Figure 1B:
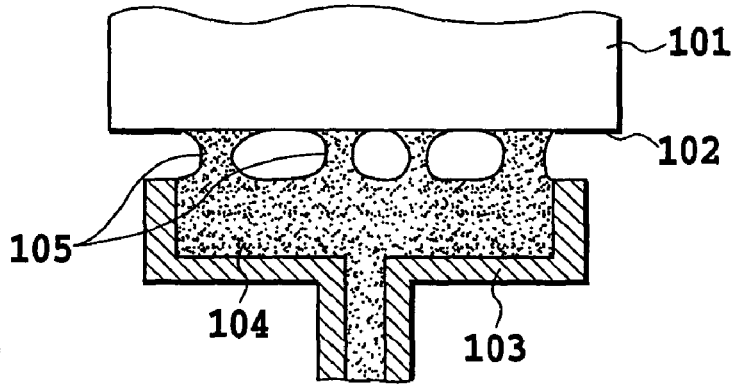
Figure 1C:
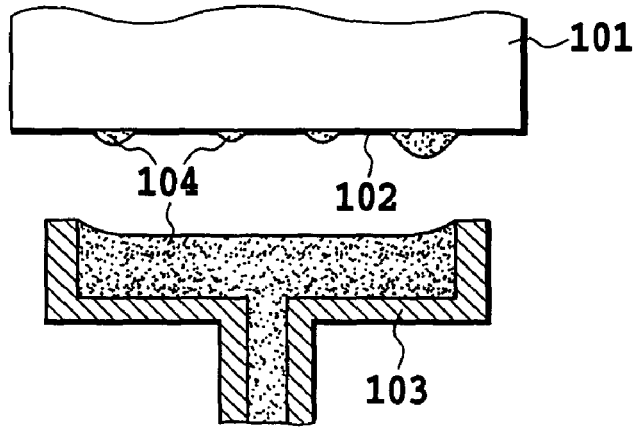
Figure 2:
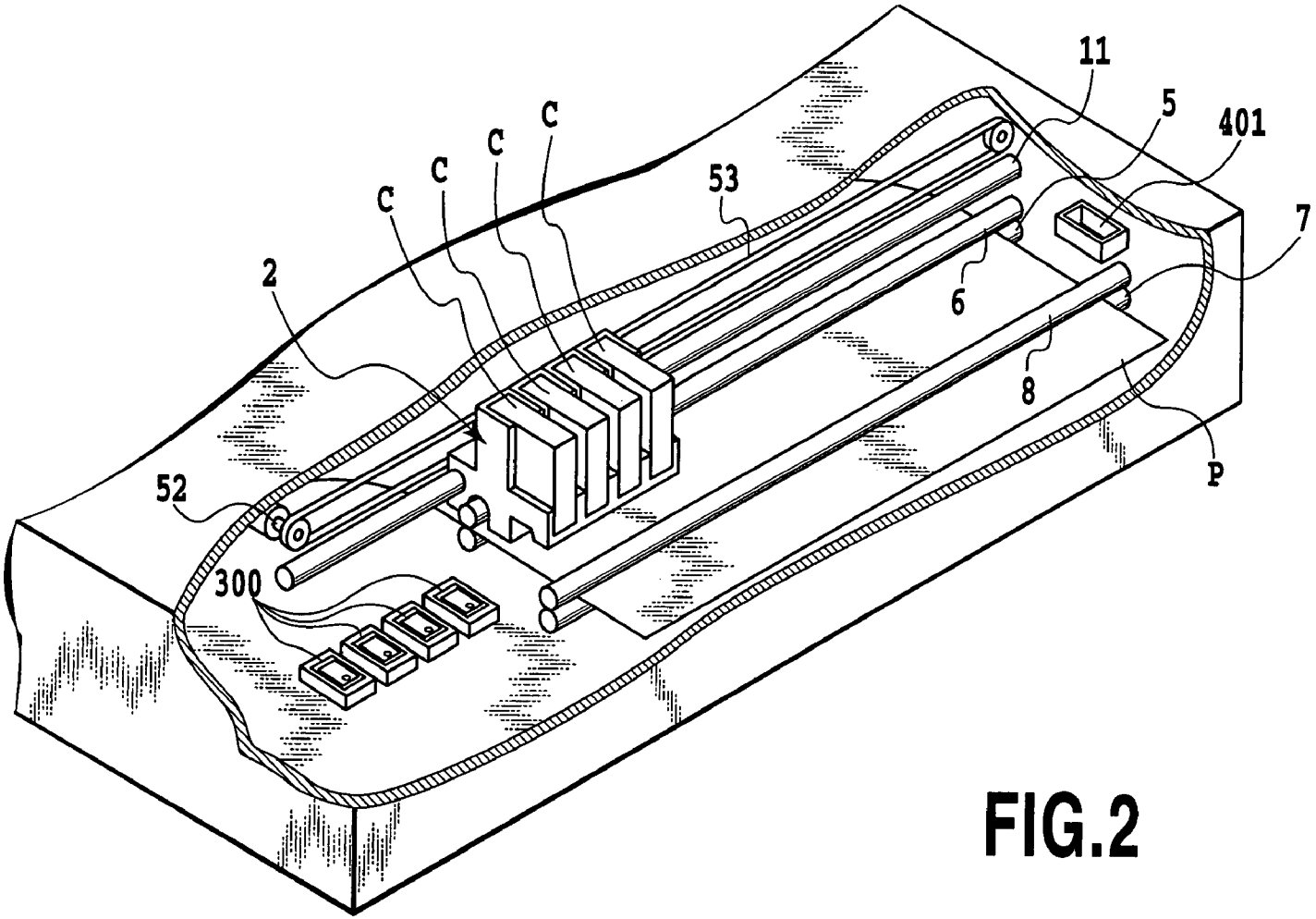
FIG. 2 is a schematic perspective view showing an ink jet printing apparatus according to one preferred embodiment of the present invention.

FIG. 2 is a perspective view showing schematically the construction of a printing apparatus provided with a printing head performing printing in accordance with an ink jet method according to one preferred typical embodiment of the present invention.

Referring to FIG. 2, a reference sign C represents an ink jet cartridge (hereinafter referred to as a "cartridge") provided with an ink tank as an ink reserving portion on an upward thereof, a printing head on a downward thereof, and a connector for receiving a signal or the like for driving the printing head. A reference numeral 2 represents a carriage mounted with a plurality of cartridges C. Ink of a color different from each other, such as yellow, magenta, cyan, black, or the like, is reserved in the respective ink tanks of the four cartridges C. The carriage 2 is provided with a connector holder for transmitting the signal or the like for driving the printing head of each of the cartridges C so as to establish an electrical connection with the printing head. In the example shown in FIG. 2, four cartridges C with a yellow ink, a magenta ink, a cyan ink, and a black ink reserved, as seen from the left rightward, in the respective ink tanks are mounted.

A reference numeral 11 represents a scanning rail extending in a direction in which the printing head is scanned (a main scanning direction) to slidably support the carriage 2. A reference numeral 52 represents a carriage motor. A reference numeral 53 represents a driving belt transmitting a driving force of the carriage motor 52 for making the carriage 2 a reciprocating motion in the main scanning direction. Reference numerals 5 and 6, and 7 and 8, represent pairs of transport rollers disposed at a front and a rear of a printing position by the printing head on a printing medium and pinching and transporting the printing medium. A reference sign P represents a printing medium, such as paper or the like. The printing medium P is pressed up against a guide surface of a platen (not shown) for regulating evenly a printing surface of the printing medium P.

The printing head provided for the cartridge C mounted on the carriage 2 protrudes downwardly from the carriage 2 and is disposed between the transport rollers 6 and 8. An ejection port surface, on which ejection ports of the printing head are formed, is opposed in a parallel state to the printing medium P regulated evenly by the guide surface of the platen (not shown).

In the printing apparatus according to the present embodiment, a recovery system unit is disposed, for example, on a home position side on the left-hand side in FIG. 2.

Referring to FIG. 2 and concerning the recovery system unit, a reference numeral 300 represents a cap unit provided for each of the printing heads provided for each of the four cartridges C and capable of moving in an up and down directions. The cap unit 300 composing capping means joins to, and caps, the printing head when the carriage 2 is located at a home position. The cap unit 300 thereby prevents ink inside the ejection ports of the printing head from evaporating, thereby preventing a viscosity of the ink from increasing or volatile constituents from evaporating and sticking, and thus preventing a discharge failure from occurring.

In addition, the cap unit 300 is provided with a cap member 12 and a mechanism for operating the cap member 12 to be described later with reference to FIGS. 4A to 4C and 5A to 5C. An interior of the cap member communicates with a pump unit (not shown) serving composing suction means. The pump unit generates a negative pressure in accordance with requirements. Timing for generating the negative pressure is, for example, when a suction recovery sequence is performed with the cap unit 300 joined to the printing head for the case that the printing head develops an ejection failure problem, and when the ink ejected in the cap of the cap unit 300 during a preliminary ejection sequence is sucked, and the like.

A reference numeral 401 represents a preliminary ejection receiving portion provided on a side opposite to the home position across a printing operation region of the printing medium P. A preliminary ejection of the printing head is performed at the preliminary ejection receiving portion 401. An arrangement may also be provided, in which a blade formed with an elastic member, such as a rubber or the like, is provided for the recovery system unit, used for wiping off liquid droplets sticking to the ejection port surface of the printing head.

In the printing apparatus according to the present embodiment, a single motor is used as a transportation drive motor for transporting the printing medium P and a drive motor for operating the recovery system unit.

Figure 3:
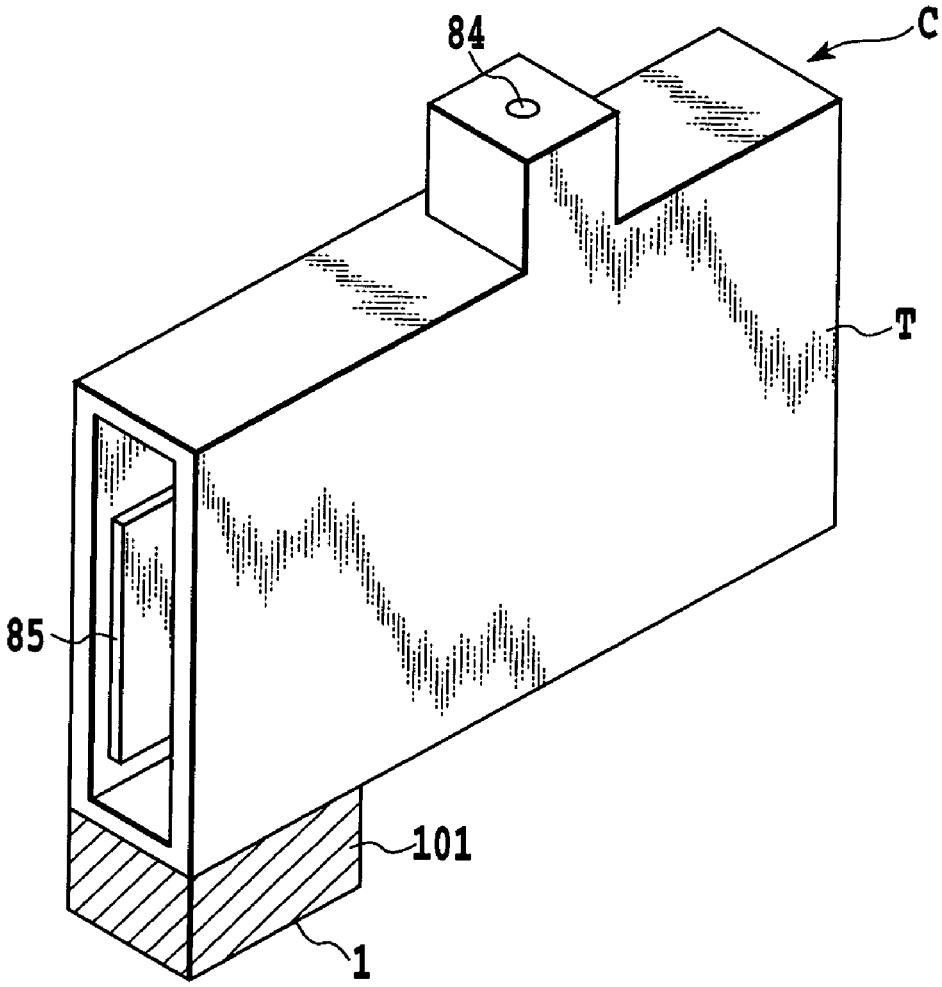
FIG. 3 is a perspective view showing an ink jet cartridge used in the ink jet printing apparatus shown in FIG. 2.

FIG. 3 is a perspective view showing the ink jet cartridge C integrating the printing head with the ink tank used in the ink jet printing apparatus according to the present embodiment.

As shown in FIG. 3, the ink cartridge C is provided with an ink tank T on an upper portion thereof and a printing head 101 on a lower portion thereof. Further, an air hole 84 is provided in an upper portion of the ink tank T and a head side connector 85 is provided at a position in line with the ink tank T. The connector 85 is provided for receiving a signal for driving the printing head 101 and outputting an ink level detection signal. An ejection port surface 1 having a plurality of ejection ports opening on a bottom surface side downward in FIG. 3 is formed on the printing head 101. An electro-thermal converting element for generating thermal energy required for ejecting the ink is disposed in each liquid path portion communicating with the ejection port.

Figure 4A:
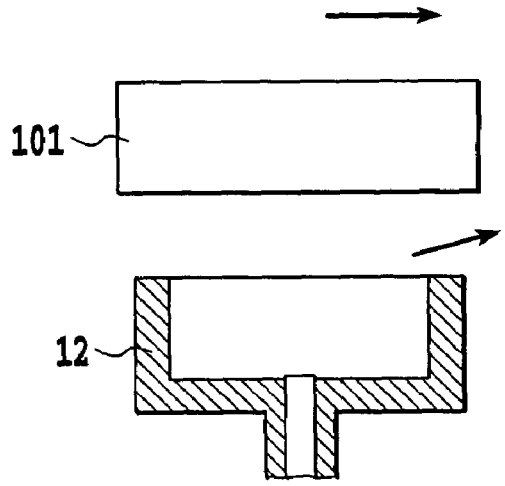
FIGS. 4A to 4C are schematic fragmentary sectional views for explaining a suction recovery operation in the ink jet printing apparatus according to the embodiment of the present invention, in which a cap is separated in an oblique attitude with respect to the movement of a carriage.
Figure 4B:
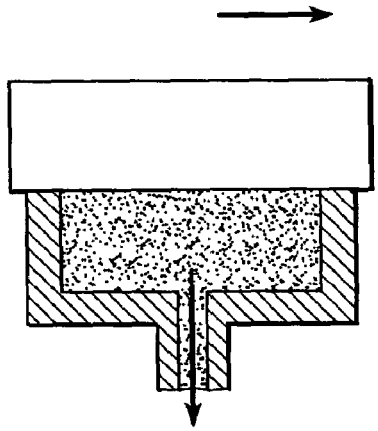
Figure 4C:
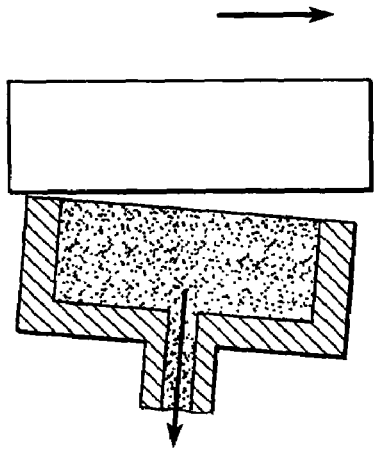

FIGS. 4A to 4C are schematic diagrams showing open/close operations of the cap member 12 in the cap unit 300 during the suction recovery sequence. This operation is carried out through a movement of the carriage 2 mounted with the printing head 101 in the main scanning direction.

When the printing head 101 performs a printing operation, the cap member 12 composing the capping means is generally retracted to a position away from the carriage 2 as shown in FIG. 4A.

Referring to FIG. 4B, for a suction, the printing head 101 mounted on the carriage 2 moves to the right and the cap member 12 contacts with the printing head 101. A negative pressure is then generated inside the cap by the pump connected to the cap in order to suck ink in the direction of the arrow shown in FIG. 4B, thereby filling the printing head with ink.

Referring to FIG. 4C, after the suction, the printing head 101 moves further to the right and thereby one end of the cap member 12 is pressed down in a direction of leaving away from the printing head. The atmosphere is then drawn into the inside of the cap, thus further sucking ink accumulated in the cap.

Figure 5A:
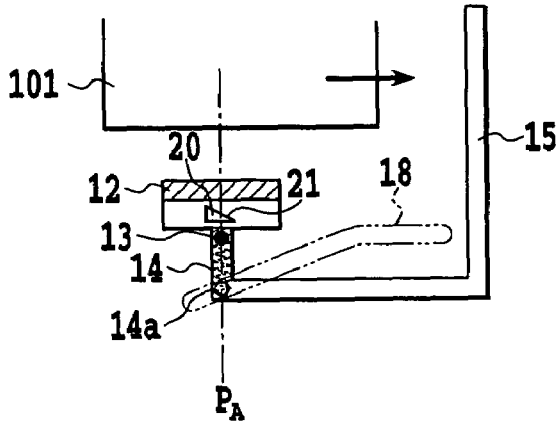
FIGS. 5A to 5C are schematic views showing cap means according to the embodiment of the present invention.
Figure 5B:
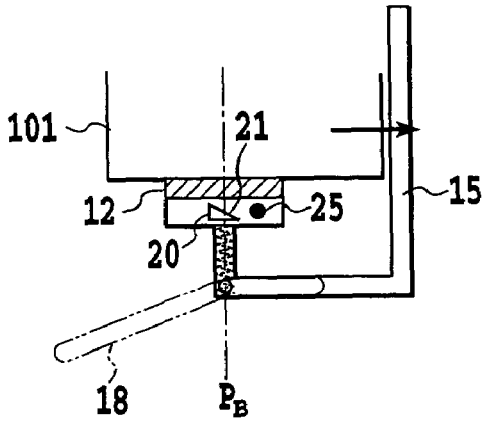
Figure 5C:
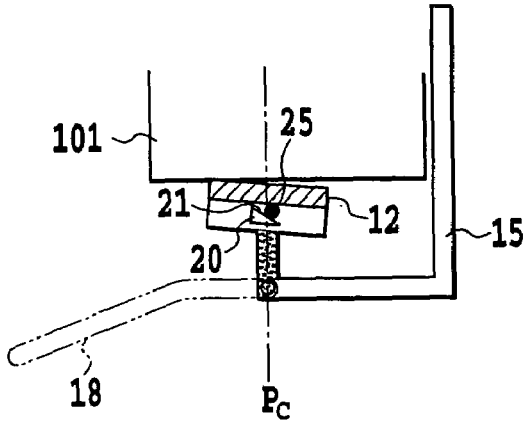

FIGS. 5A to 5C are views showing an operating mechanism for the cap member 12 realizing the aforementioned open/close operation according to the present embodiment.

As shown in FIG. 5A, the cap member 12 is attached rotatably to a supporting member 14 with an elastic member 13 such as a spring and the like. A lower support 14*a* of the supporting member 14 is connected rotatably to an L-shaped guide member 15, part of which extends onto a scanning path of the printing head 101. Further, the cap member 12 is provided with a protruded portion 20 having a slant surface 21 at a location near an upper portion of the supporting member 14. An elongated portion of the lower support 14*a* of the supporting member 14 is engaged with a trajectory groove 18 provided in a fixing member attached to a casing of the printing apparatus. This allows the lower support 14*a* to move together with the cap member 12 and the guide member 15 along the trajectory groove 18.

According to the present embodiment, the following operation is executed for the suction. Referring to FIG. 5B, as the printing head 101 moves to the right to contact with the guide member 15, the cap member 12 moves upward along the trajectory groove 18. At a cap closing operation position PB, the cap member 12 contacts with the ink ejection port surface 1 of the printing head 101 mounted on the carriage 2, performing a cap closing operation to cover the ink ejection port surface.

After the completion of suction, as shown in FIG. 5C, the carriage 2 moves further to the right. Then, at a cap opening operation position PC, a fixed protruded portion 25 attached to the casing of the printing apparatus contacts the protruded portion 20 of the cap member 12, which causes the fixed protruded portion 25 to ride over the slant surface 21 of the protruded portion 20. This, in turn, results in the cap member 12 rotating about an upper portion of the supporting member 14, thus making one end of the cap member 12 leave off the ink ejection port surface, which makes up a cap opening operation.

According to such a cap open/close operation as that described above, when the cap is separated from the printing head after the suction operation, it may occurs that the cap is separated in a state in which the negative pressure inside the cap remains high, and then an adhesion of the cap with the printing head by the negative pressure generated in the cap becomes greater than a force for the carriage moving. This could cause the carriage to be unable to move, resulting in a carriage error. Even if the cap can be separated from the printing head by accident, it results in the atmospheric pressure being instantaneously applied to the inside of the cap, in which there is left the negative pressure. Then, the meniscus inside the ejection ports is destroyed, as described earlier, by the sudden fluctuations in pressure occurring at this time and the mechanical impact exerted when the cap is separated. This results in air getting into the back of the ejection port, which could cause an ink ejection failure to occur.

Further, in the case that the cap is separated from the printing head in a state, in which the negative pressure inside the cap has returned to zero (that is, the atmospheric pressure), the ejection port of the printing head is kept to contact with ink of a mixture of a plurality of different colors, which stays inside the cap, for an extended period of time, as described earlier. As a result, the ink may flow back to the printing head. If printing an image is performed in this condition, an image problem of a color mixture is likely to occur, in which the original colors are mixed with other ones.

FIG. 6 is a table showing a frequency of occurrence of a carriage error occurring when the cap is separated from the printing head immediately after the suction operation (that is, when the negative pressure inside the cap remains high), and of an ejection failure occurring as a result of air entered in the ejection ports.

A sequence is performed repeatedly, which is comprised of performing a suction recovery operation and subsequently printing a pattern for each suction operation, which pattern is used for checking as to whether a correct ejection was performed to print a correct image after a suction operation. The sequence was carried out repeatedly 50 times and it is then determined that the carriage error occurred 11 times and five out of a total of 50 printed patterns showed the ejection failure occurring from the air entered in the ejection ports. When the sequence was carried out up to 100 times, the carriage error occurred 25 times and nine printed patterns showed images of ejection failures.

FIG. 7 is a table showing a frequency of occurrence of a color mixture occurring when the cap is separated after the carriage has been stopped until the negative pressure in the cap disappears, after the suction operation (that is, when the negative pressure inside the cap is zero).

A sequence is performed repeatedly, which is comprised of performing the suction recovery operation and subsequently printing a pattern for each suction operation, which pattern is used for checking as to whether a correct ejection was performed to print a correct image after a suction operation. The sequence was carried out repeatedly 50 times and it is determined that seven patterns out of 50, and 12 patterns out of 100, showed a color mixture. This means that performing a cap opening operation with remaining of a high negative pressure generated in the cap during the suction operation or after the negative pressure has returned to the atmospheric pressure results in various types of problems and image failures occurring.

Figure 8:
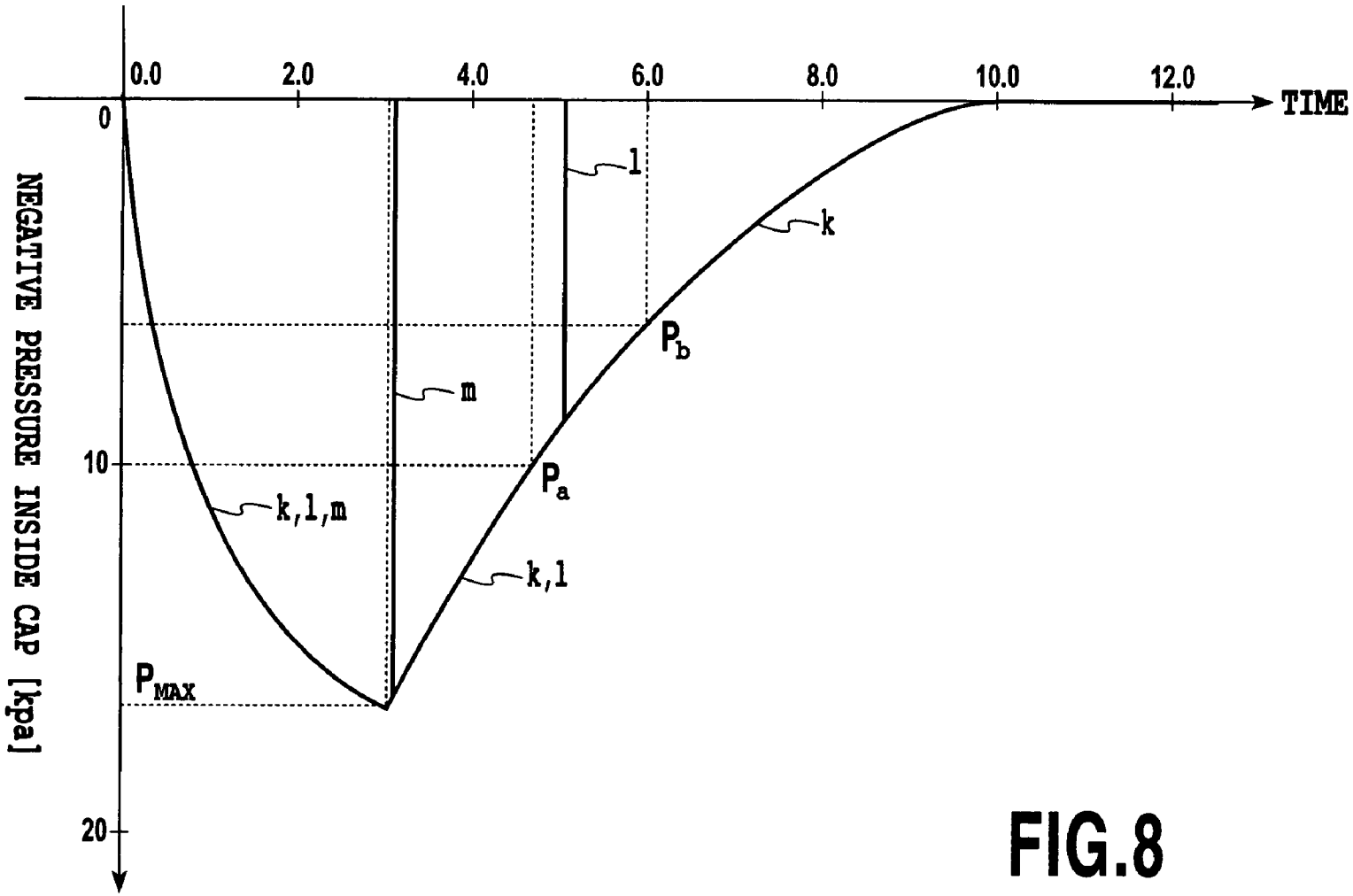
FIG. 8 is a chart representing fluctuations with time of a negative pressure generated in a cap during a suction operation, in the case that the suction operation is performed according to one preferred embodiment of the present invention.

FIG. 8 is a chart representing fluctuations with time of the negative pressure generated in the cap during a suction operation including the suction operation performed according to the present embodiment.

Referring to FIG. 8, the ordinate represents the negative pressure in the cap [kPa] and the abscissa represents an elapsed time as counted from the start of the suction operation[s].

Referring to FIG. 8, a solid line k is a negative pressure curve of a case, in which the carriage is stopped so as not to open the cap until the negative pressure generated by the suction operation disappears completely. As explained earlier with reference to FIG. 7, when the cap opening operation is performed after the carriage has been stopped to completely decrease the negative pressure in the cap, the discharge ports and the ink staying inside the cap remains in contact with each other for about 10.0 seconds. This increases the possibility of the color mixture occurring.

Referring to FIG. 8, a solid line m is a negative pressure curve of a case, in which the cap opening operation is performed in a condition in which the negative pressure generated in the cap by the suction operation is the highest. As explained earlier with reference to FIG. 6, during this operation, the joining force of the cap to the printing head by the negative pressure generated in the cap becomes greater than the force of the carriage moving. For this reason, the carriage is unable to move, resulting in a carriage error occurring. Even if the cap can be separated from the printing head by accident, it results in the atmospheric pressure being instantaneously applied to the inside of the cap, in which there is left the negative pressure. Then, the meniscus inside the ejection port is destroyed by the sudden fluctuations in pressure occurring at this time and the mechanical impact exerted when the cap is separated. This results in the air getting far deep into the back of the ejection port, which could cause an ink ejection failure to occur.

Referring to FIG. 8, a solid line 1 is related to a recovery operation performed according to the present embodiment. The solid line 1 is a negative pressure curve of a case, in which a cap opening help operation is performed. The cap opening help operation involves the carriage being stopped and stationary at a suction position for a period of time from about 4.5 seconds to about 6.0 seconds, after the start of the suction (that is, for the period of time during which the negative pressure in the cap reaches a point between Pa and Pb).

Pa is the lower limit value of the negative pressure which allows the cap opening operation to be performed without causing a carriage error and an ink ejection failure due to air entered far deep into the back of the ejection port, and is obtained through an experiment. Pb is the upper limit value of the negative pressure which allows the cap opening operation to be performed without causing a color mixture, and is obtained through an experiment.

Since the above negative pressure curves have reproducibility, it is possible to bring the negative pressure in the cap into a predetermined negative pressure range with ease by stopping the carriage at the suction position for a predetermined period of time after the start of the suction operation, without having to provide means for detecting the negative pressure inside the cap.

FIG. 9 is a table showing a frequency of occurrence of the carriage error, the ejection failure caused by air entered in the ejection port, and the color mixture, which occur when the suction operation that draws the negative pressure curve 1 as explained in FIG. 8 is performed.

A sequence is performed repeatedly, which is comprised of performing the suction recovery operation and subsequently printing a pattern for each suction operation, which pattern is used for checking as to whether a correct ejection was performed to print a correct image after a suction operation, in the same manner as in the operations described with reference to FIGS. 6 and 7. The sequence was carried out repeatedly 100 times and it is determined that none of image failures and the problems such as the carriage error, the ejection failure caused by air entered in the ejection port, and the color mixture have occurred, as shown in FIG. 9.

Though the solid line 1 shown in FIG. 8 is the pressure curve in which a stoppage of the carriage after the suction operation is employed as the cap opening help operation, other cap opening help operations may be used.

One possible cap opening help operation is, for example, a micro-reciprocating motion of the carriage performed a predetermined number of times along the main scanning direction at the suction position from a predetermined point in time so that the negative pressure inside the cap after the suction pump has been stopped (after Pmax in FIG. 8) reaches a point between Pa and Pb, and the motion is experimentally obtained.

Similarly, another possible cap opening help operation may be a pump's pressurization operation using a predetermined pressure in a positive pressure direction performed for a predetermined period of time from a predetermined point in time so that the negative pressure inside the cap after the suction pump has been stopped (after Pmax in FIG. 8) reaches a point between Pa and Pb, and the pressurization is experimentally obtained.

Also in the case that the cap opening operation is performed after the negative pressure in the cap reaches a point between Pa and Pb by the above other cap opening help operations, the same effect can be obtained as with the negative pressure curve 1 shown in FIG. 8. Furthermore, the same effect can be obtained as with the negative pressure curve 1 shown in FIG. 8 by performing the cap opening operation after the negative pressure inside the cap has been made to reach a point between Pa and Pb through the cap opening help operation that combines the stoppage of the carriage, the micro-reciprocating motion of the carriage performed at the suction position, and the pump's pressurization operation in a positive pressure direction.

As described in the foregoing, if the cap opening help operation is performed for facilitating the cap opening operation when the cap performs the cap opening operation in relation to the printing head after ink has been charged and supplied to the printing head by the suction means, it ensures a stabilized suction operation. It is therefore possible to provide a highly reliable ink jet printer that causes no ejection failures or the like.

(Second Embodiment)

A second embodiment of the present invention is concerned with a cap opening help operation performed during a suction operation in an ink jet printer performing a cap open/close operation by moving a carriage in a main scanning direction. The cap opening help operation is performed for facilitating the cap opening operation when it is determined that the cap opening operation cannot be performed as detected during the suction operation.

As described in the foregoing for the first embodiment, the operations of the printing head and the cap during the suction operation through the movement of the carriage in the main scanning direction are the same as those shown in FIGS. 4A to 4C. During the suction, the suction operation is performed in the condition shown in FIG. 4B. When the atmosphere is drawn into the inside of the cap after the suction and then ink staying therein is sucked (idle suction), the operation of the cap and the carriage is the same as shown in FIG. 4C. When the operation shifts from a state shown in FIG. 4B to a state shown in FIG. 4C, the cap opening help operation is performed, in which the negative pressure generated inside the cap is released uniformly throughout all of the suction operations according to the first embodiment of the present invention. According to the second embodiment of the present invention, however, cap opening operation detection means for detecting whether or not the cap opening operation can be performed is employed and, if it is detected that the cap opening operation cannot be performed, then the cap opening help operation is performed.

Figure 10:
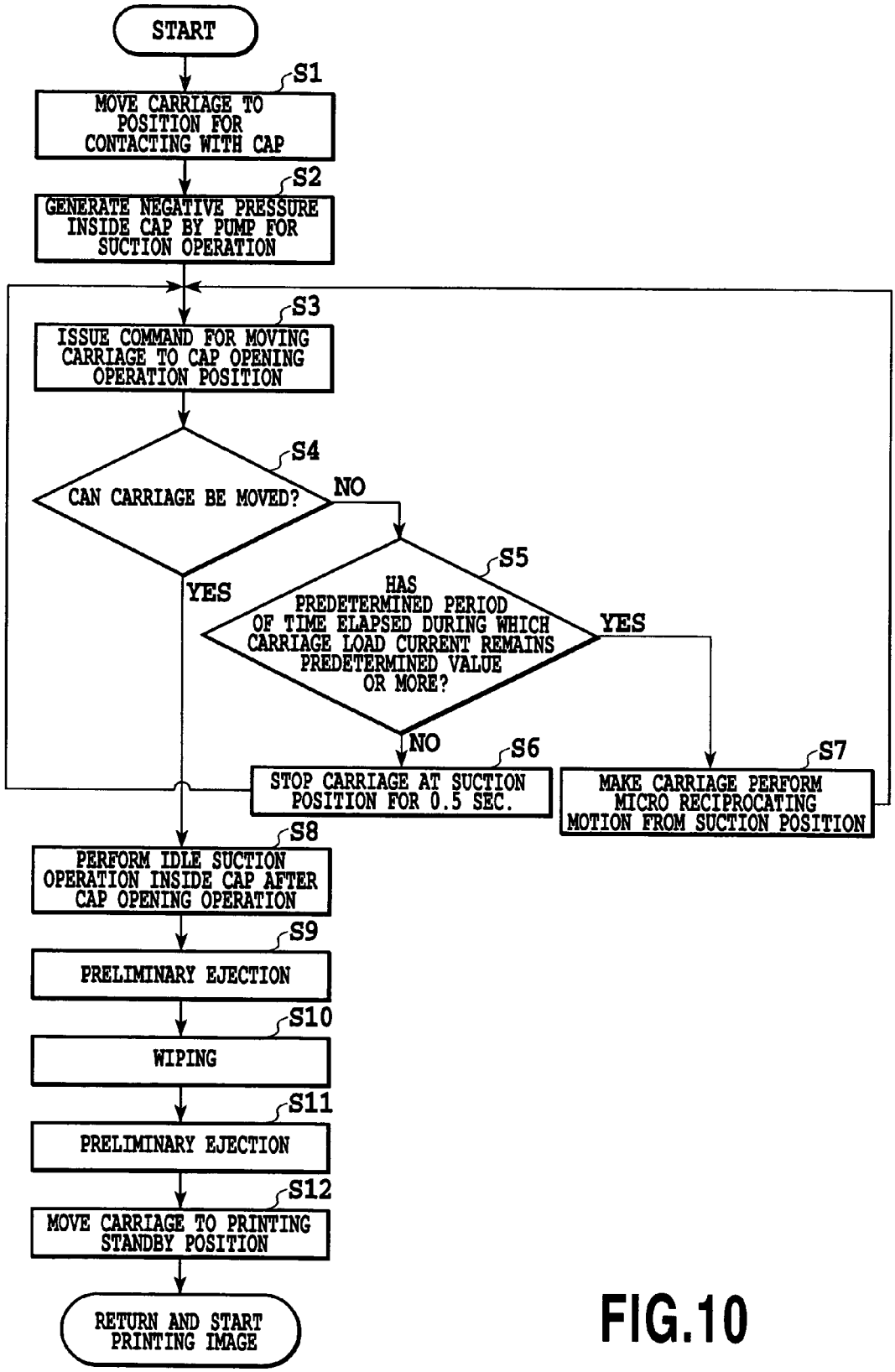
FIG. 10 is a flowchart showing a sequence of a suction operation performed by an ink jet printer according to a second embodiment of the present invention.

FIG. 10 is a flowchart showing a sequence of the suction operation performed by the ink jet printer according to the present embodiment.

The operations shown in FIG. 10 will be explained below with reference to FIGS. 5A to 5C.

When the ink jet printer receives a command for executing the suction operation, the carriage moves to the cap closing operation position PB, at which the carriage contacts with the cap, in a step S1.

In a step S2, a negative pressure is generated inside the cap through an operation of a pump mechanism connected to the cap and the suction operation is carried out to fill the printing head with ink.

In a step S3, a command is issued for moving the carriage to the cap opening operation position PC, at which the cap opening operation is carried out.

In a step S4, an encoder for detecting a motion of the carriage, composing the cap opening detection means, detects to determine if the carriage has moved to the cap opening operation position PC, at which the cap opening operation is carried out, in accordance with the command issued in the step S3.

If it is determined in the step S4 that the cap opening operation cannot be executed, then it is further determined in a step S5 whether or not a load current flowing at that time through a motor for moving the carriage in the main scanning direction is a predetermined value or more and whether or not a predetermined period of time or more has elapsed in that condition.

If the conditions specified for the step S5 are not met, then, in a step S6, the carriage is stopped at the suction position for 0.5 seconds in order to decrease the negative pressure generated inside the cap 12. After the carriage 2 has been stopped, the operation returns to the step S3 and the command is issued for moving the carriage to the cap opening operation position PC, at which the cap opening operation is carried out.

If the conditions specified for the step S5 are met (if it is considered that the negative pressure inside the cap 12 is higher than the step S6), then, in a step S7, the carriage 2 is made to perform a micro-reciprocating motion in the main scanning direction from the suction position. The number of cycles of the micro-reciprocating motion can be established through an appropriate method, including an experiment conducted in advance for finding the number of cycles. This operation involves application of an external force to the cap in a direction of separating the cap 12 from the printing head 101 in a condition, in which the cap 12 is held in tight contact with the printing head 101. It is therefore possible to decrease the negative pressure within a shorter period of time than when decreasing the negative pressure by stopping the carriage 2. After the carriage 2 has been made to perform the micro-reciprocating motion, the operation returns to the step S3 once again and the command is issued for moving the carriage 2 to the cap opening operation position PC, at which the cap opening operation is carried out.

If it is determined in the step S4 that the cap opening operation can be executed as a result of the encoder detecting to determine whether or not the carriage has moved to the cap opening operation position PC, at which the cap opening operation is carried out, in accordance with the command issued in the step S3, ink staying inside the cap is sucked (idle suction) in a step S8 after the cap opening operation.

In a step S9, a preliminary ejection after the suction is carried out.

In a step S10, a wiping after the suction operation is carried out.

In a step S11, a preliminary ejection after the wiping is carried out. Then in a step S12, the carriage is moved to a printing standby position.

In the sequence of processing shown in FIG. 10, to determine whether or not the cap opening operation can be performed, the cap opening operation detection means comprises a combination of the predetermined amount of movement of the carriage, the predetermined value of the current flowing through the motor for operating the carriage, and the predetermined continuous period of time of the current value. It is nonetheless possible to use each individual element of these means as the cap opening operation detection means for determining whether or not the cap opening operation can be performed.

In the sequence of processing shown in FIG. 10, either the stoppage of the carriage or the micro-reciprocating motion of the carriage is selected as the cap opening help means when it is determined that the cap opening operation cannot be performed as a result of the detection made to determine whether or not the cap opening operation can be performed. It can still be embodied, as in the first embodiment, to combine the different cap opening auxiliary means so as to include the stoppage of the carriage, the micro-reciprocating motion of the carriage, the use of a pump for pressurization of a predetermined pressure in a positive pressure direction, and the like.

FIG. 11 is a table showing a frequency of occurrence of a carriage error occurring when the cap is opened after the suction, an ejection failure occurring as a result of air entered in the ejection port, and a color mixture in the ink jet printer implemented with the sequence as explained in FIG. 10.

A sequence is performed repeatedly, which is comprised of performing the suction recovery operation according to the sequence shown in FIG. 10 and subsequently printing a pattern for each suction operation, which pattern is used for checking as to whether a correct ejection was performed to print a correct image after a suction operation. The sequence was carried out 100 times and it is determined that none of the problems and image failures of the carriage error, the ejection failure occurring as a result of air entered in the ejection port, and the color mixture have occurred, as shown in FIG. 11.

According to the second embodiment as described in the foregoing, in the ink jet printer performing the cap open/close operation by moving the carriage in the main scanning direction, when the cap performs the cap opening operation in relation to the printing head after ink has been charged and supplied to the printing head by the suction means, a detection is made to determine whether or not the cap opening operation can be performed and, if it is determined that the cap opening operation cannot be performed, the cap opening help operation is performed for facilitating the cap opening operation performed by the capping means. This ensures an efficient and stabilized suction operation. It is therefore possible to provide a highly reliable ink jet printer that shows no ejection failures or the like.

As explained in the foregoing, according to the embodiments of the present invention, it is possible to provide a small, low-cost, and highly reliable ink jet printing apparatus performing smoothly the suction operation for the printing head and producing stabilized image outputs.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus comprising:

a carriage mounted with a printing head for ejecting ink and for scanning the printing head in a main scanning direction;

a suction pump for sucking ink from the printing head;

capping means for performing a cap closing operation in which an ejection port surface of the printing head is covered with a cap when said suction pump sucks ink from the printing head and performing a cap opening operation in which the cap is separated from the ejection port surface after suction by said suction pump;

help means for performing a cap opening help operation that facilitates the cap opening operation, when said capping means performs the cap opening operation;

detection means for detecting whether the cap opening operation by said capping means can be performed or not; and control means for causing said help means to perform the cap opening help operation if said detection means detects that the cap opening operation by said capping means cannot be performed.

2. An ink jet printing apparatus as claimed in claim 1, wherein the cap opening and cap closing operations by said capping means are performed by means of moving of the carriage in the main scanning direction.

3. An ink jet printing apparatus as claimed in claim 1, wherein said detection means detects whether said carriage can move or not.

4. An ink jet printing apparatus as claimed in claim 3, wherein said detection means includes means for detecting a moving distance of said carriage by means of an encoder detecting a position of said carriage.

5. An ink jet printing apparatus as claimed in claim 3, wherein said detection means includes means for detecting a value per unit of time of current flowing in a power source for driving said carriage.

6. An ink jet printing apparatus as claimed in claim 3, wherein said detection means includes means for detecting whether a value per unit of time of current flowing in a power source for driving said carriage is more than a predetermined value and the value more than the predetermined value continues for a predetermined time.

7. An ink jet printing apparatus as claimed in claim 1, wherein said help means includes means for stopping the cap at the printing head for a predetermined time.

8. An ink jet printing apparatus as claimed in claim 1, wherein said help means includes means for performing a micro-reciprocating motion of said carriage in the main scanning direction.

9. An ink jet printing apparatus as claimed in claim 1, wherein said help means includes means for causing predetermined positive pressure inside the cap for a predetermined time.

10. An ink jet printing apparatus as claimed in claim 1, wherein said help means comprises first help means for stopping the cap at the printing head for a predetermined time, second help means for performing a micro-reciprocating motion of said carriage in the main scanning direction, and third help means for causing predetermined positive pressure inside the cap for a predetermined time.

11. An ink jet printing apparatus as claimed in claim 1, wherein said detection means comprises first detection means for detecting a value per unit of time of current flowing in a power source for driving said carriage, second detection means for detecting whether a value per unit of time of current flowing in a power source for driving said carriage is more than a predetermined value and the value more than the predetermined value continues for a predetermined time, and third detection means for detecting a moving distance of said carriage by means of an encoder detecting a position of said carriage.

* * * * *